US005255448A

United States Patent [19]

Buckner

[11] Patent Number: 5,255,448

[45] Date of Patent: Oct. 26, 1993

[54] DRY CAN DRYING APPARATUS HAVING TANGENTIAL BLOWERS

[76] Inventor: Lynn Buckner, P.O. Box 609, Chickamauga, Ga. 30707

[21] Appl. No.: 900,565

[22] Filed: Jun. 18, 1992

[51] Int. Cl.[5] ..... F26B 3/08

[52] U.S. Cl. ..... 34/114; 34/155

[58] Field of Search ..... 34/114, 115, 116, 117, 34/110, 113, 155

[56] References Cited

U.S. PATENT DOCUMENTS 1,601,332 9/1926 Whitehead et al. ..... 34/115

1,890,568 12/1932 Bleibler ..... 34/114

*Primary Examiner*—Henry A. Bennett

*Attorney, Agent, or Firm*—Ronald P. Kananen

[57] ABSTRACT

Apparatus for drying fabric and yarn includes a plurality of dry cans for transferring heat to the material and elongate tangential blowers parallel and adjacent to the dry cans to circulate air at the surfaces of the dry cans. Each tangential blower has an outlet having a length substantially equal to the length of the dry cans and in substantial alignment with the dry cans, as well as a width extending over a substantial arc of the tangential blower. The tangential blowers also include tangential blower wheels with axial vanes extending substantially the length of the tangential blowers and the dry cans, and inlets extending over substantially the same length as that of the dry cans. The tangential blowers are pivotally mounted so that the orientation of the outlets can be adjusted. In an alternate embodiment, a heating coil is positioned at the inlet of the tangential blowers to heat the air entering the tangential blowers.

18 Claims, 9 Drawing Sheets

DRY CAN DRYING APPARATUS HAVING TANGENTIAL BLOWERS

BACKGROUND OF THE INVENTION

The present invention relates to apparatus for drying textiles and similar materials and, more particularly, to apparatus including dry cans for heating and evaporating moisture from the materials.

In the manufacture of textile yarns and fabrics, wet yarns and fabrics are dried by passing them over a series of rollers called dry cans, which are cylindrical vessels through which steam is passed to heat the vessels, and to heat and dry the material which comes in contact with the surfaces of the vessels. The material is fed around the vessels such that it typically contacts a large portion of the circumference of the vessel surface, and the vessels are rotated in order to advance the material. The heat of the vessels causes evaporation of the moisture in the material, and the moisture is typically drawn off through an overhead hood. However, there are regions around and between adjacent dry cans in which the evaporated moisture stagnates. The drying of an advancing web of material in these regions is hindered by the presence of the moisture.

SUMMARY OF THE INVENTION

In accordance with the present invention, tangential blowers, or fans, are positioned among the dry cans adjacent to regions where vapor stagnation takes place in order to circulate the air in these regions to avoid build-up of the moisture and allow the moisture to be taken off through the hood. The tangential blowers are in housings having outlets extending substantially the axial length of the dry cans, the tangential blowers having elongate vanes of substantially the same length as the dry cans. The vanes are arranged substantially radially with respect to the tangential blowers and cause the flow of a stream of air which is tangential to the tangential blowers and has a width substantially equal to the length of the dry cans. Each tangential blower has a guard defining inlet openings to allow air to be drawn in along the entire length of the tangential blower over a substantial portion of its periphery. The tangential blower has a housing including a baffle and back plate which permit air to be exhausted from each tangential blower over a desired arc on a substantially opposite side of the tangential blower from the inlet. The tangential blower housing is pivotally mounted to allow the orientation of the outlet and, thus, the direction of the outlet stream of air to be varied. Air both enters and exits through the face of a tangential blower wheel defined by the elongate vanes, and, thus, the tangential blower moves a substantially equal volume and pressure of air across the width of the face.

Air issuing from the outlet of the blower impinges the material being dried and thereby reduces the concentration of water vapor at the surface of the material. The impinging air reduces the partial pressures of vapors at the surface of the material being dried and increases the differential pressure between the liquids in the material and the vapor in the air surrounding the material. Since the rate of evaporization is proportional to the differential of partial pressures, the drying capacity and/or the drying rate of the apparatus according to the present invention is increased.

In an alternate embodiment, the tangential blower is equipped with a heating coil. The heating coil is positioned in the inlet air stream, and the coil preheats the inlet air stream. Preheating of the inlet air stream results in heating the air being forced from the tangential blower outlet. The outlet is oriented so as to impinge the preheated air onto the moisture laden yarn or fabric to be dried on the steam dry cans. The additional preheating of the air improves drying efficiency, and speed and/or capacity.

DETAILED DESCRIPTION OF THE PREFERRED EMBODIMENTS OF THE INVENTION

Figure 1:
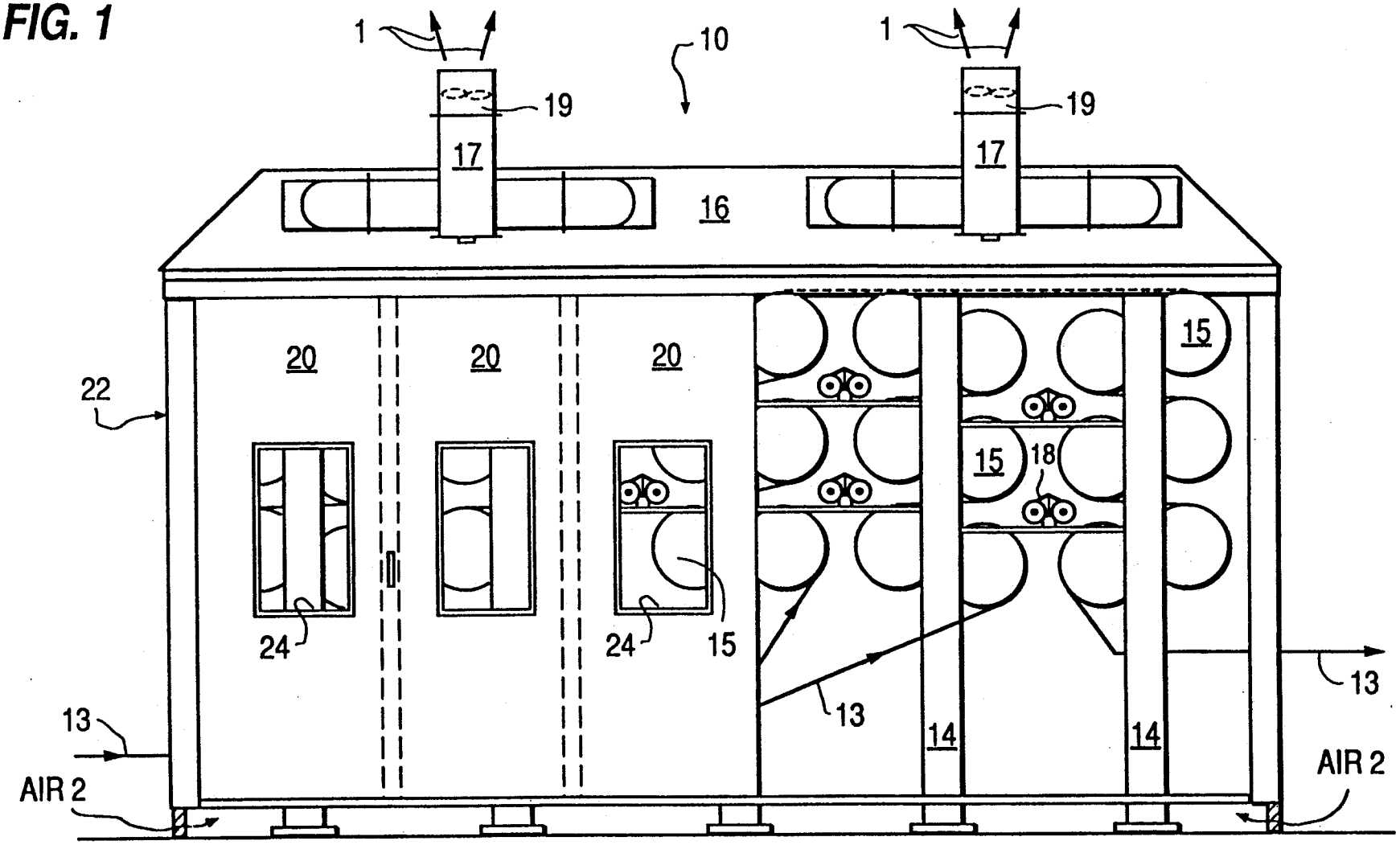
FIG. 1 is a front elevation of the textile dry can apparatus according to the invention for use in drying yarn with some doors of the enclosure opened.
Figure 2:
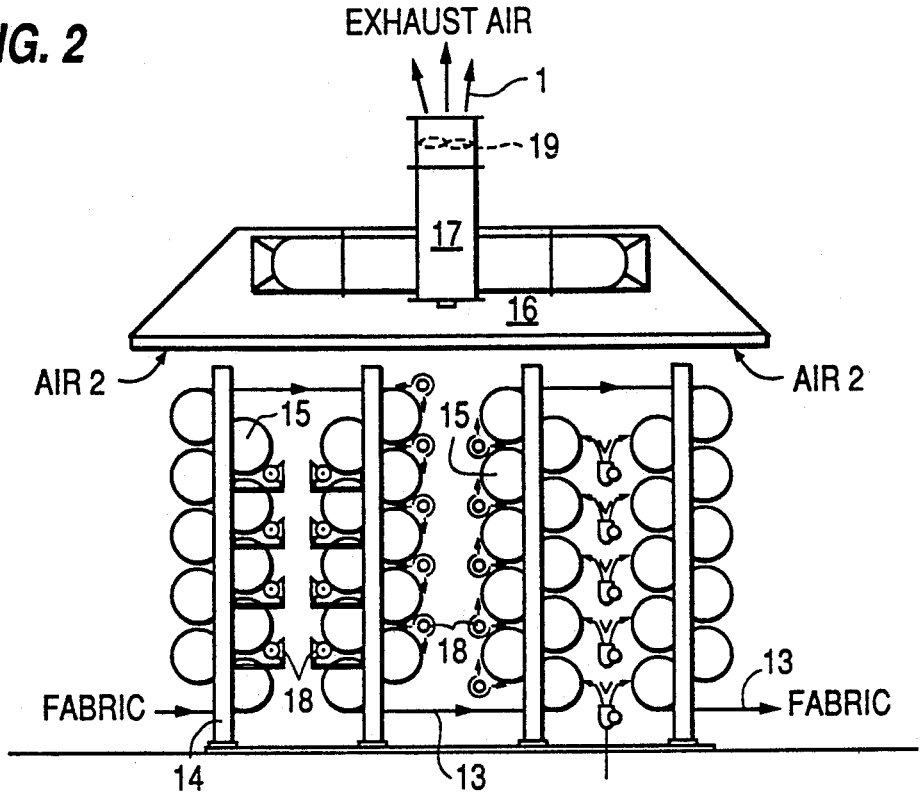
FIG. 2 is a front elevation of a textile dry can apparatus according to the invention for use in drying fabric, less the dry can enclosure.
Figure 3:
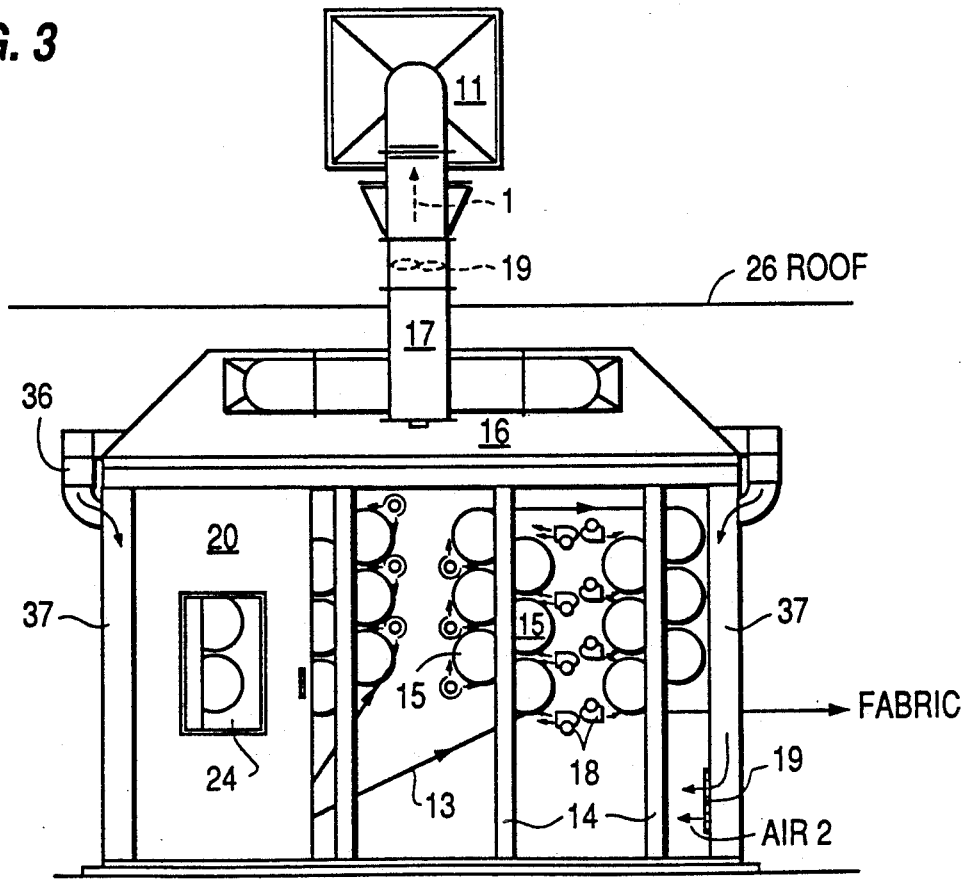
FIG. 3 is a front elevation of another embodiment of textile dry can apparatus according to the present invention for use in drying fabric, with some doors of the enclosure opened.

As can be seen from FIGS. 1–3, the apparatus according to the present invention, which is designated generally by the reference numeral 10, includes an apparatus for removing moisture from yarn, fabric or other material 13 in which a plurality of rollers, or dry cans, 15 is supported in a horizontal orientation on uprights. The material 13 to be dried is passed around and in contact with the circumferences of the dry cans 15 serially in a tortuous path. The dry cans 15 have hollow interiors, and steam is introduced into the dry cans 15 to heat them and thereby transfer heat to the material 13 to evaporate the moisture in the material.

The arrows 1 indicate the exhaust air, containing moisture created from drying the water from the textile material, such as yarn or fabric. Ambient air 2 in a building containing the dry can apparatus, or from the outside, surrounds the dry can apparatus 10.

Air laden with the moisture of evaporation is drawn off overhead from the apparatus through a hood 16 as the warm moisture laden air rises above the dry cans and conducted through an exhaust duct 17 by exhaust fans 19. In such an apparatus, a heavy concentration of water vapor tends to collect near the surface of the dry cans.

In order to prevent the build-up of moisture laden air among the dry cans 15, a plurality of tangential blowers 18 is provided. As can be seen from the right side of FIG. 1, from which sliding access doors 20 of an enclosure 22 have been opened, a tangential blower 18 is positioned adjacent to each space between adjacent dry cans 15, with the exception of the end vertical rows of dry cans. The enclosure 22 is typically made of stainless steel and includes end panels 23, the sliding access doors 20 on the sides, and windows 24. The enclosure 22 provides a consistent drying environment isolated from the surrounding area.

Figure 4:
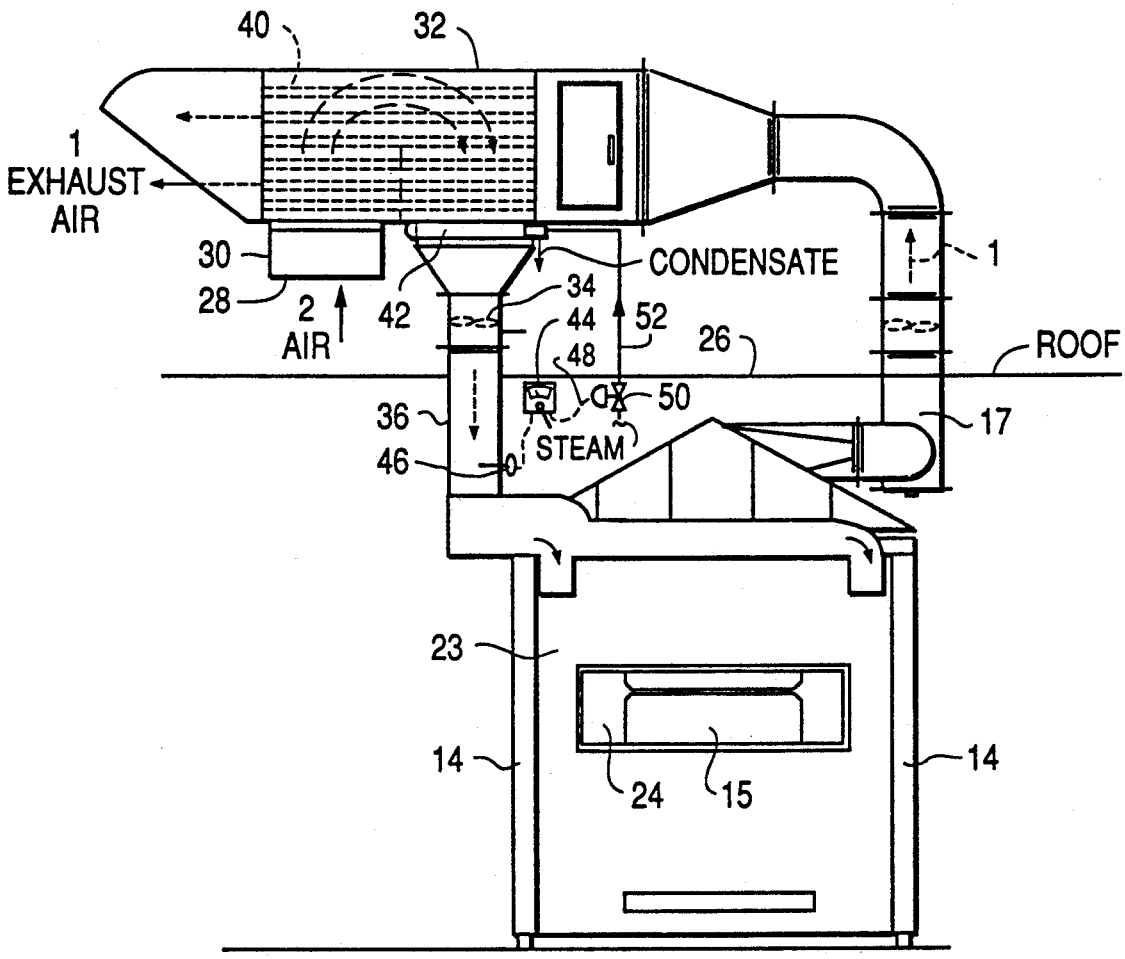
FIG. 4 is an end elevation of the textile dry can apparatus of FIG. 3.

As can be seen from FIG. 4, fresh ambient air 2 from outside the building containing the apparatus 10 (above a roof 26) enters an inlet 28 in an exterior duct 30 from which the ambient air 2 passes through a shell-and-tube heat exchanger 32 before being forced into the enclosure 22 of the apparatus 10 by a tangential blower 34 positioned in a connecting duct 36. Outlets 38 from the connecting duct 36 are positioned at the top of the chamber defined by the enclosure 22. Heat for preheating the incoming ambient air 2 is provided by the exhaust air 1, which passes through tubes 40 in the heat exchanger 32 before exiting to outside air. The incoming ambient air 2 can be further heated by a heating coil 42 positioned, for example, in the connecting duct 36 between the heat exchanger 32 and the outlets 38 in the chamber defined by the enclosure 22. The heat energy for the heating coil 42 can be steam or condensate from the dry cans 15. The ambient air 2 entering through the connecting duct 15 is make-up air. Control apparatus 44 has a sensor 46 mounted in the connecting ducts 36 and a control line 48 running to a power-operated valve 50 in a steam or condensate line 52 extending to the heating coil 42. The flow of steam or condensate from the dry cans 15 to the heating coil 42 can be adjusted by opening or closing the valve 50 in response to the temperature of the incoming ambient air 2 as it reaches the sensor 46. The sensor 46 sends a signal for the control apparatus 44 to appropriately open or close the valve 50. The connecting duct 36 has branch ducts 37 extending along the ends of the enclosure to inlet grills 19 near the bottom of the chamber.

Figure 5:
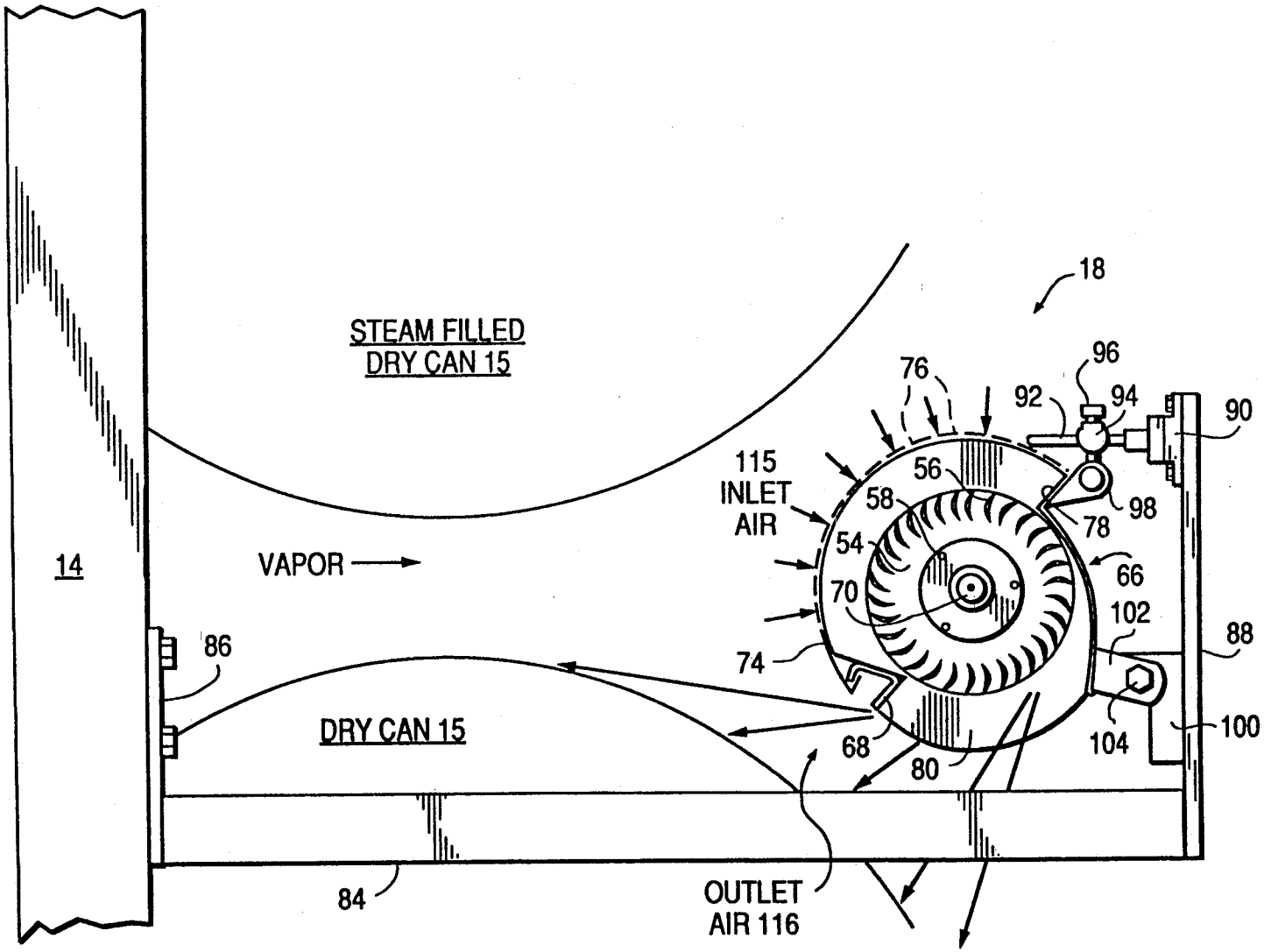
FIG. 5 is an enlarged end view of a tangential blower and support in the apparatus of FIG. 2.
Figure 6:
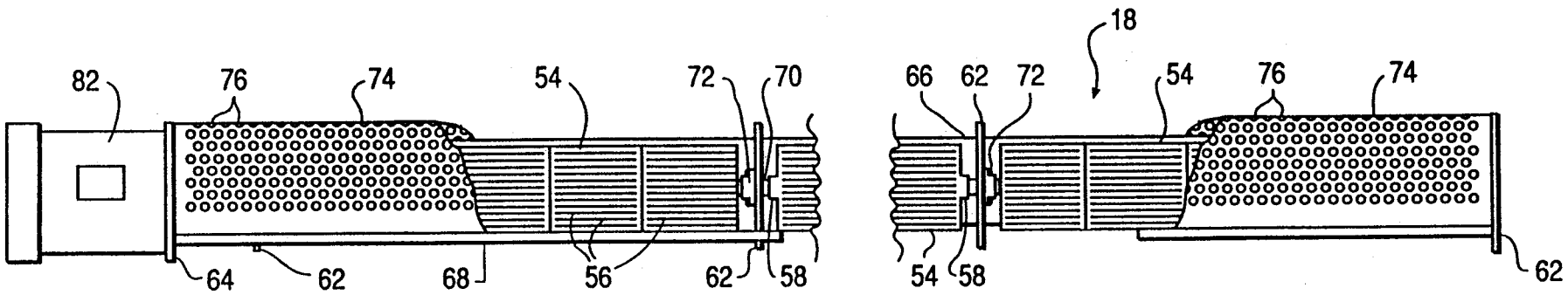
FIG. 6 is a side view, with a portion of the guard cut away, of the tangential blower of FIG. 5.

As can best be seen from FIGS. 5 and 6, each tangential blower 18 includes tangential blower wheels 54 having a plurality of elongate vanes 56 parallel to the axis of the wheels and extending the length of the wheels. The vanes 56 are radially oriented and are curved in the radial direction so that air exits the wheels 54 in a stream tangential to the wheels. The stream of air has a width substantially equal to the length of the dry cans 15. Air both enters and exits through the face of the wheels 54, which is defined by the vanes 56. Thus, the tangential blower 15 moves an equal volume and pressure of air across the entire length of the tangential blower face.

The wheels 54 include not only the vanes 56 but also hubs 58, which support the tangential blower wheels 54 on drive shafts 70. The hubs 58 are attached to the drive shafts 70 by, for example, set screws (not shown). The air foils of the vanes 56 are arranged in such a manner as to move the air through the wheels 54 so that the air exits tangent to the wheels. Each tangential blower wheel 54 is mounted in a housing 60 including bearing support baffles 62, an end motor mount baffle 64, an elongate back plate 66, and a stiffener angle member 68. The back plate 66 serves as the main support structure for the housing 60 and serves to deflect the air through the tangential blower wheels 54. The stiffener angle member 68 is connected to the bearing support baffles 6 and the end motor mount baffle 64, and serves as a support structure for the housing 60. The stiffener angle member 68 also deflects the air flow through the tangential blower wheels 54. The end motor mount baffle 64 is an integral part of the tangential blower housing 60. A plurality of the tangential blower wheels 54 are mounted coaxially with one another within each tangential blower housing 60.

A shaft 70 extends through the tangential blower wheels 54 and is supported in bearings 72 mounted on the bearing support baffles 62, which are plates at the ends of the tangential blower housing 60 and between adjacent tangential blower wheels 54. A curved guard plate 74 extends the length of the tangential blower housing 60 over a substantial arc of the tangential blower wheels 54, for example, over an arc just slightly less than 180°. The bearing support baffles 62 are circular plates having notches formed in their peripheries to accommodate the stiffener angle member 68 and the guard plate 74, which extend the length of the tangential blowers 18. The guard plate 74 includes a plurality of openings 76 extending over the entire extent of the guard plate to allow air to flow into the tangential blower 18, the openings 76 defining the inlet for the tangential blower. For example, the openings 76 can be circular openings having a diameter of 5/16th inches along rows of such openings in which the centers of the openings are spaced ⅜ths inch from one another, with the openings of one row being staggered with respect to the openings of adjacent rows and the centers of the openings of the one row being spaced from the centers of the openings of the adjacent rows by ⅜ths inch. The size, number and spacing of the openings 76 are chosen to provide the guard plate 74 with a substantial free open area through which the inlet air can pass. The guard plate 74 extends from the stiffener angle member 68 which runs the axial length of the tangential blower 18 and projects from the circumference of the tangential blower wheels 54 generally radially outward, thereby defining one side of the tangential blower inlet.

At the opposite side of the inlet is a radially extending flange 78 on the back plate 66, the flange 78 extending from the circumference of the tangential blower wheels 54. The main portion of the back plate 66 diverges gradually from the circumference of the tangential blower wheels 54. The diverging portion of the back plate 66 defines one side of an outlet opening 80 for the tangential blower 18, the opposite side being defined by the stiffener angle member 68. The ends of the outlet opening 80 are in substantial alignment with the ends of the dry cans 15. The inlet and the outlet 80 of each tangential blower housing 60 are diametrically opposite with respect to the tangential blower wheels 54. The inlet of the housing 60 is in communication with 180° of the circumference of the tangential blower wheels 54, and the outlet 80 is in communication with the opposite 180° of the circumference of the tangential blower wheels. Air enters the tangential blower 18 through the openings 76 in the guard plate 74, which prevents foreign objects from entering the tangential blower, and is expelled tangentially from the tangential blower wheels 54 through the outlet opening 80. The tangential stream of air issuing from the tangential blower wheel is directed at the surface of an adjacent dry can 15. The outlet 80 covers a substantial area, having not only a length substantially equal to the length of the dry cans 15, but a width extending over a substantial arc, approximately 190°, of the tangential blower 18. One end of the shaft 70 is driven by an electric motor 2 supported by the end motor mount baffle 64.

Each tangential blower 18 is supported at the desired position by a base channel 84 mounted on an upright 14 by a mounting plate 86, the base channel 4 being cantilevered from the upright 14. At the projecting end of the base channel 84, a mounting base plate 88 projects upward, and the tangential blower 18 is supported on the base plate 88 at a plurality of upper positions and lower positions. At each upper position, a ball joint mounting bracket 90 is secured, and a connecting rod 92 integral with the ball of the ball joint 90 extends back toward the upright 14. An adjustable member 94 having a through bore is slidably mounted on the connecting rod 92 and includes a set screw 96 for securing the member 94 at a desired position. A swivel style mounting bracket 98 welded to each end of the tangential blower housing 18 is pivotally connected to a projecting portion of the adjustable member 94. At each lower mounting location, a mounting bracket 100 is secured which has an aperture for connection to a clevis 102 by a bolt 104 and nut so that the clevis can pivot relative to the bracket. The clevis 102 has a base secured to the back plate 66. When it is desired to adjust the orientation of the tangential blower 18, the adjustable member 94 is slid along the connecting rod 92, and the connecting rod 92 can be pivoted up and down by virtue of the ball joint mounting bracket 90. Adjustments at the upper locations are accommodated by the pivoting of the clevises 102 on the mounting brackets 100 at the lower locations.

Figure 7:
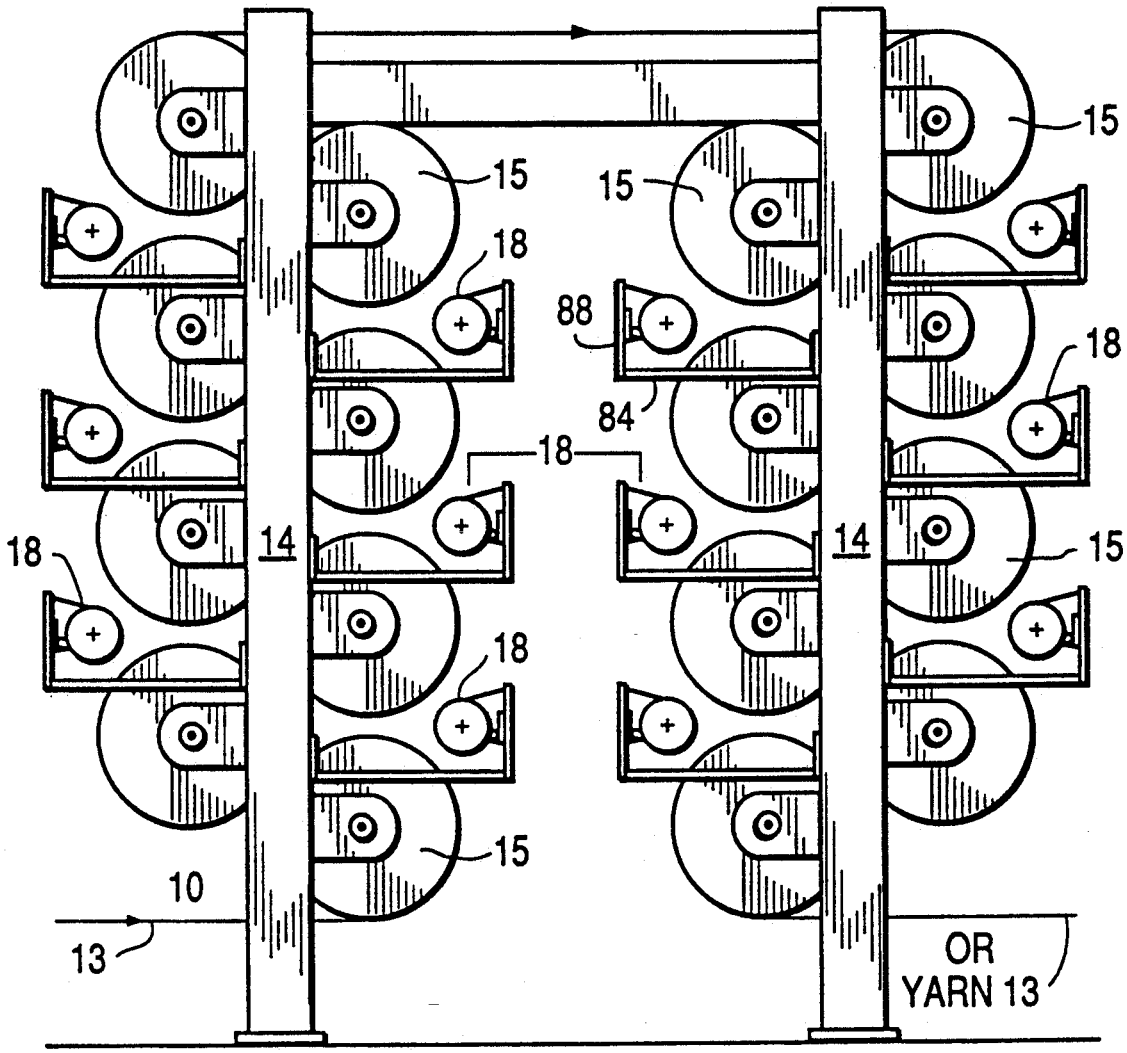
FIG. 7 is an enlarged end view of an arrangement of dry cans and tangential blowers from the apparatus according to the present invention.
Figure 8:
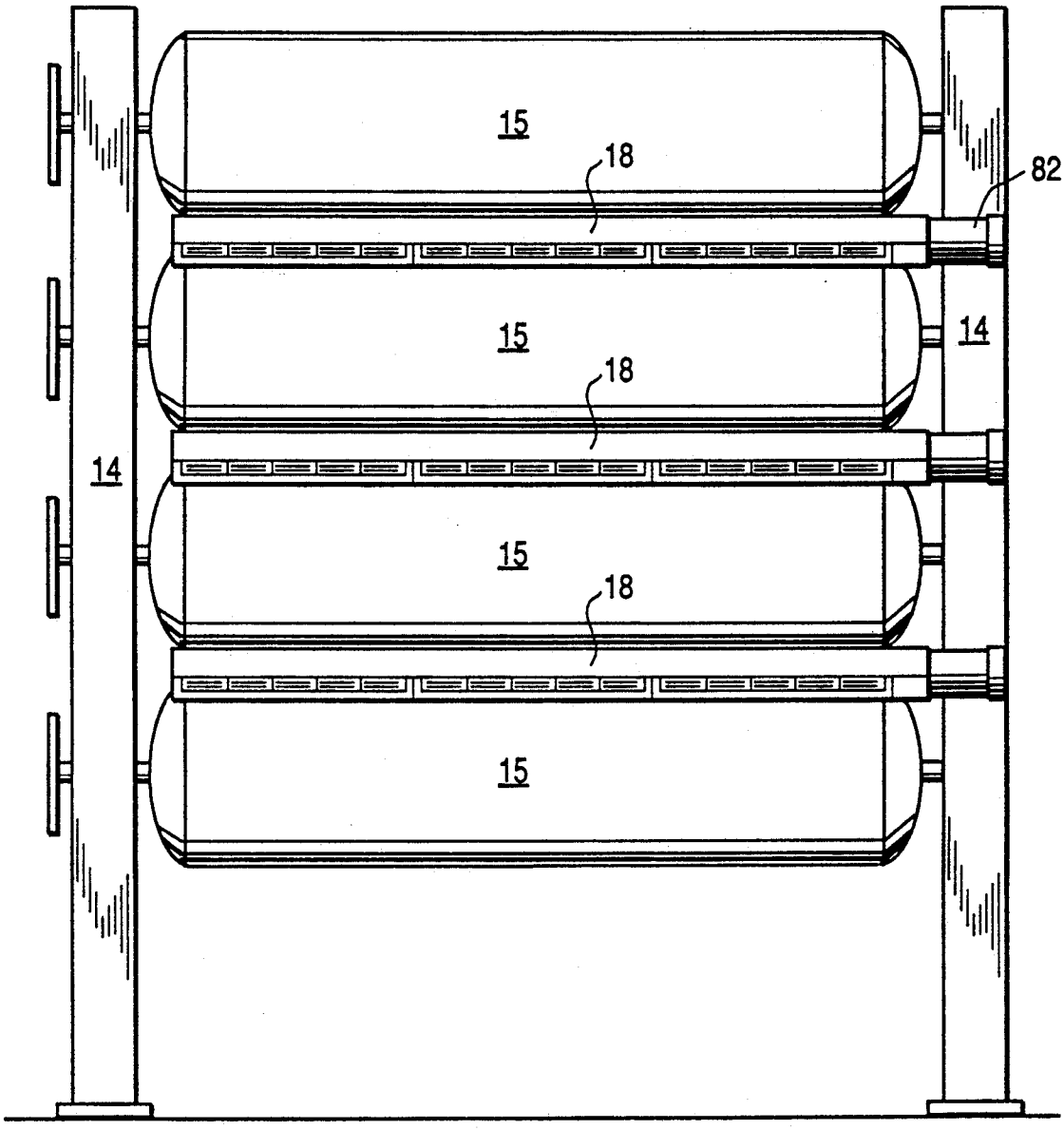
FIG. 8 is a side view of the arrangement of dry cans and tangential blowers of FIG. 7.

Air issuing from each tangential blower 18 impinges on an adjacent dry can 15 and moves along the circumference of the dry can, entraining the vapor which the heat of the dry cans produces from the moisture in the material to be dried. As a result of the movement of the air and entraining of the moisture, the moisture is not permitted to stagnate around the material and thereby hinder the drying of the material. As can be appreciated from FIGS. 7 and 8, a tangential blower 18 is mounted at each crevice between adjacent dry cans 15 and extends substantially the entire axial length of the dry cans 15. Not only does the outlet 80 of each tangential blower 18 extend along the entire length of the nip between adjacent dry cans 15, but the inlet for the tangential blower 18 extends for the same length to draw in air and vapor from the opposite side of the tangential blower 18 and thereby add to the circulating effect of the tangential blower.

Figure 9:
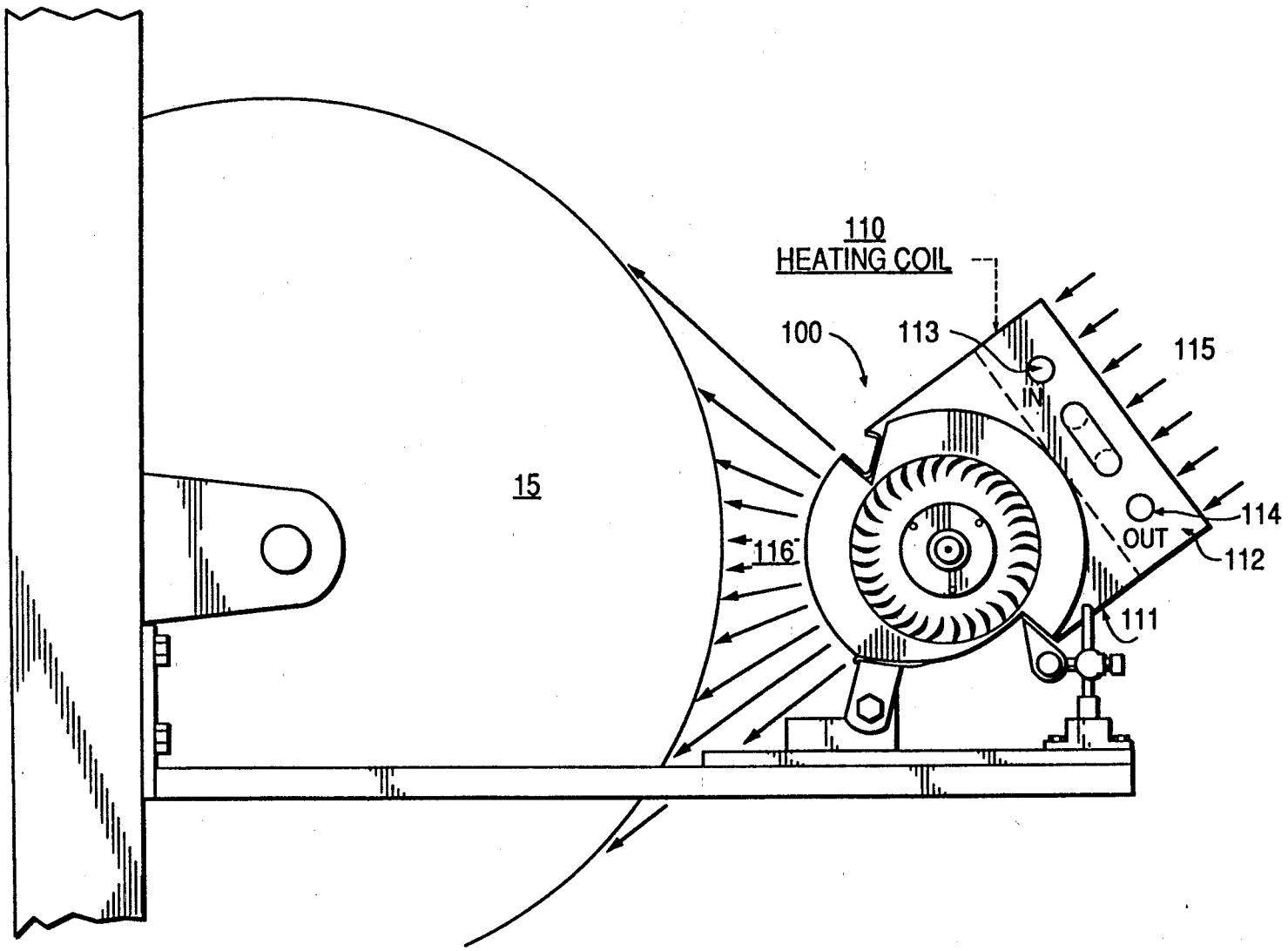
FIG. 9 is an end view of an alternate tangential blower having an inlet air heating coil.
Figure 10:
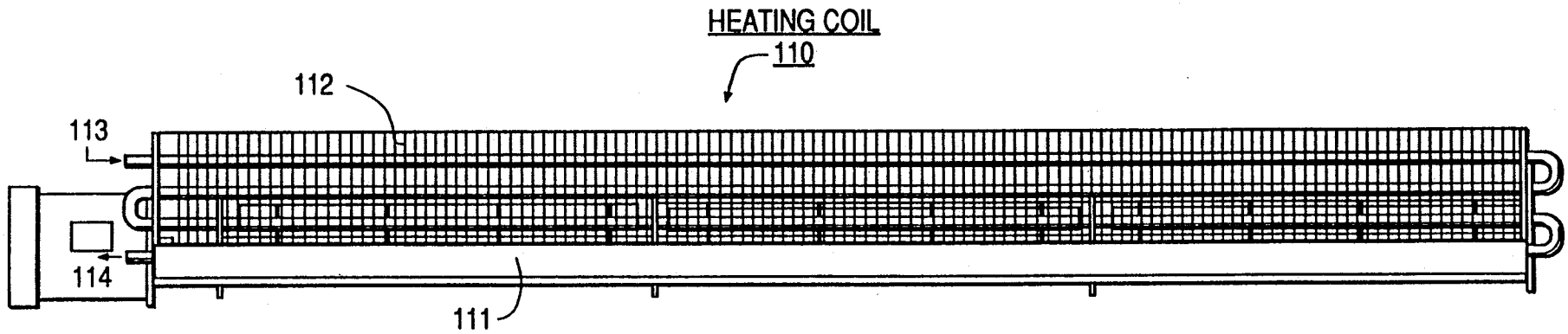
FIG. 10 is a side view of the tangential blower of FIG. 9 with its air heating coil.

As can be seen in FIGS. 9 and 10, in an alternate embodiment, each tangential blower 100 includes a plurality of the blower wheels 54, of undetermined length, located on the common drive shaft 70. The plurality of undetermined length blower wheels 54 are so arranged as to force air 116 from the blower 100 equally in volume and pressure along the length of the outlet 80, which is determined to be substantially equal to the length of the dry can cylinder face 15. The tangential blower 100 of the alternate embodiment differs from the tangential blower 18 of the first described embodiment in that inlet air 115 passes across a heating coil 110 composed of coil fins 112, heating coil tubes 113 and 114, and a side coil plate 111. A heating medium enters the coil inlet tube 113 and exits coil outlet tube 114. The heating medium can include but is not limited to steam, condensate, hot liquids, and hot gases. As an alternative, an electrical heating element can be used. The coil fins 112 serve to provide increased surface area for the transfer of energy (heat) from the heating coil tubes 113, 114 to the inlet air 115. The greater the surface area of the coil fins 112, the greater the rate and/or capacity to transfer energy (heat) to the inlet air 115.

Increasing the temperature of the inlet air 115 increases the temperature of the outlet air 116 which is in turn impinged upon the moist material to be dried on the dry can cylinder face. Thus, the outlet air temperature is elevated by the inlet air heating coil 110. The warmer the outlet air 116 temperature, the greater the differential temperature between the wet bulb temperature and the dry bulb temperature, thus reducing the relative humidity of the air surrounding the moist material to be dried. The lower the relative humidity at the location of evaporization, the greater the rate of evaporization. Thus, the warmer the inlet coil preheats the inlet air, the greater the rate of evaporization. Drying capacity and/or drying speeds of the drying apparatus is improved.

It will be apparent to those skilled in the art and it is contemplated that variations and/or changes in the embodiments illustrated and described herein may be made without departure from the present invention. Accordingly, it is intended that the foregoing description is illustrative only, not limiting, and that the true spirit and scope of the present invention will be determined by the appended claims.

I claim:

1. Apparatus for drying material of indeterminate length, comprising:

a plurality of rollers around which the material is advanced, each roller having an axial length;

a source of heat to dry the material;

at least one tangential blower extending substantially parallel to and adjacent to one of said rollers, said tangential blower including an inlet opening, an outlet having a length substantially equal to the axial length of said rollers, and means for moving air through said tangential blower, said air moving means comprising air moving surfaces substantially parallel to said one of said rollers, said air moving surfaces each having a length substantially equal to the axial length of said rollers;

whereby said tangential blower moves a substantially equal volume and pressure of air throughout the axial length of said rollers.

2. The apparatus of claim 1, wherein said rollers have hollow interiors and said source of heat is connected to the hollow interiors of said rollers.

3. The apparatus of claim 2, wherein said rollers are parallel to one another and are equal in axial length.

4. The apparatus of claim 3, wherein the outlet of said tangential blower is directed at one of said rollers.

5. The apparatus of claim 3, wherein there are a plurality of said tangential blowers, the axis of each said tangential blower lying in a plane extending between adjacent rollers.

6. The apparatus of claim 1, wherein said air moving surfaces are vanes.

7. The apparatus of claim 6, wherein said vanes are mounted in tangential blower wheels having open interiors.

8. The apparatus of claim 1, further comprising a,.enclosure enclosing said rollers and said tangential blower.

9. The apparatus of claim 8, further comprising means for moving ambient air into said enclosure, means for exhausting heated air from said enclosure, and means for transferring heat from said heated air to the ambient air moving into said enclosure.

10. The apparatus of claim 1, further comprising means for supporting said tangential blower, said supporting means comprising means for adjusting the orientation of said outlet of said tangential blower.

11. The apparatus of claim 7, wherein said vanes comprise means for discharging the air tangent to said tangential blower wheels.

12. The apparatus of claim 1, wherein said outlet has a width extending over an arc of approximately 90° of said tangential blower.

13. The apparatus of claim 1, wherein said inlet opening has a length substantially equal to the axial length of said rollers.

14. The apparatus of claim 1, wherein said one of said rollers has axial opposite ends and said outlet of said tangential blower has opposite ends, said ends of said outlet being in substantial lateral alignment with said ends of said one of said rollers.

15. The apparatus of claim 7, wherein a plurality of said blower wheels are mounted on a common drive shaft and driven by a common power source.

16. The apparatus of claim 15, wherein the axial lengths of said blower wheels, taken together, substantially equal the axial length of said rollers.

17. The apparatus of claim 1, further comprising means positioned at said inlet opening for heating air entering said tangential blower.

18. An apparatus for drying material of indeterminate length, comprising:

a plurality of rollers around which the material is advanced, each roller having an axial length;

a source of heat to dry the material;

at least one tangential blower extending substantially parallel to and adjacent to one of said rollers, said tangential blower including an inlet opening, an outlet having a length substantially equal to the axial length of said rollers and means for moving air through said tangential blower, said air moving means comprising air moving surfaces substantially parallel to said one of said rollers, said air moving surfaces each having a length substantially equal to the axial length of said rollers;

wherein said tangential blower moves a substantially equal volume and pressure of air along the axial length of said roller in tangential directions from said blower.

* * * * *